US012221712B2

(12) United States Patent
Nakahama

(10) Patent No.: US 12,221,712 B2
(45) Date of Patent: Feb. 11, 2025

(54) PLATING APPARATUS

(71) Applicant: EBARA CORPORATION, Tokyo (JP)

(72) Inventor: Shigeyuki Nakahama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/030,235

(22) PCT Filed: Jun. 1, 2022

(86) PCT No.: PCT/JP2022/022275

§ 371 (c)(1),
(2) Date: Apr. 4, 2023

(87) PCT Pub. No.: WO2023/233571

PCT Pub. Date: Dec. 7, 2023

(65) Prior Publication Data

US 2024/0368800 A1 Nov. 7, 2024

(51) Int. Cl.

| | |
|---|---|
| ***C25D 17/02*** | (2006.01) |
| ***C25D 17/00*** | (2006.01) |
| ***C25D 17/06*** | (2006.01) |
| ***C25D 17/10*** | (2006.01) |
| ***C25D 21/12*** | (2006.01) |

(52) U.S. Cl.

CPC ..... *C25D 17/02* (2013.01); *C25D 17/007* (2013.01); *C25D 17/06* (2013.01); *C25D 17/10* (2013.01); *C25D 21/12* (2013.01)

(58) Field of Classification Search

None

See application file for complete search history.

(56) References Cited

U.S. PATENT DOCUMENTS

| | | | |
|---|---|---|---|
| 2016/0333495 A1 | 11/2016 | Kagajwala et al. | |
| 2021/0010147 A1 | 1/2021 | Takahashi | |

FOREIGN PATENT DOCUMENTS

| | | | | |
|---|---|---|---|---|
| JP | S54-138625 A | 10/1979 | | |
| JP | 2000-290798 A | 10/2000 | | |
| JP | 2002-004091 A | 1/2002 | | |
| JP | 2021-011624 A | 2/2021 | | |
| WO | WO-2012007520 A1 * | 1/2012 | ..... | C25D 17/001 |

* cited by examiner

*Primary Examiner* — Wojciech Haske
(74) *Attorney, Agent, or Firm* — BakerHostetler

(57) ABSTRACT

Provided is a technique that allows suppressing a film thickness on an outer peripheral edge of a substrate becoming non-uniform.

A plating apparatus 1 includes a plating tank, an anode, a substrate holder, at least one auxiliary anode 60*a* to 60*d*, a busbar 61 having a power feeding part 62, to which electricity is supplied, and a plurality of connecting parts 63 connected to the at least one auxiliary anode and arrayed in an extending direction of the auxiliary anode, and at least one ionically resistive element 80*a* to 80*d*. The ionically resistive element is configured to increase in resistivity of the ionically resistive element as approaching the power feeding part in an extending direction of the ionically resistive element.

6 Claims, 13 Drawing Sheets

PLATING APPARATUS

TECHNICAL FIELD

The present invention relates to a plating apparatus.

BACKGROUND ART

Conventionally, as a plating apparatus that performs a plating process on a substrate, there has been known a plating apparatus that includes a plating tank accumulating a plating solution, an anode arranged inside the plating tank, a substrate holder configured to allow arranging a substrate such that the substrate is opposed to the anode inside the plating tank, and at least one auxiliary anode (auxiliary electrode) arranged between the anode and the substrate inside the plating tank and extending so as to be along an outer peripheral edge of the substrate (see, for example, PTL 1).

CITATION LIST

Patent Literature

PTL 1: Japanese Unexamined Patent Application Publication No. 2021-11624

SUMMARY OF INVENTION

Technical Problem

In a conventional plating apparatus as described above, a busbar is used to supply electricity to the auxiliary anode in some cases. Specifically, the busbar has a power feeding part to which electricity is supplied and a plurality of connecting parts connected to the auxiliary anode and arrayed in an extending direction of the auxiliary anode. The busbar is configured to flow the electricity supplied to the power feeding part to the auxiliary anode via the connecting parts.

In the plating apparatus as described above, the connecting parts of the busbar have smaller resistance values as approaching the power feeding part. Because of this, electricity flowing from the busbar to the auxiliary anode during a plating process tends to increase in amount as approaching the power feeding part. When the plating process is performed on a substrate under the condition, a film thickness on an outer peripheral edge of the substrate possibly becomes non-uniform.

The present invention has been made in view of the above, and one of the objects of the present invention is to provide a technique that allows suppressing a film thickness on an outer peripheral edge of a substrate becoming non-uniform.

Solution to Problem (Aspect 1)

In order to achieve the object, a plating apparatus according to one aspect of the present invention includes a plating tank, an anode, a substrate holder, at least one auxiliary anode, a busbar, and at least one ionically resistive element. The plating tank is configured to accumulate a plating solution. The anode is arranged inside the plating tank. The substrate holder is configured to allow arranging a substrate such that the substrate is opposed to the anode inside the plating tank. The at least one auxiliary anode is arranged between the anode and the substrate inside the plating tank and extending so as to be along an outer peripheral edge of the substrate. The busbar has a power feeding part to which electricity is supplied and a plurality of connecting parts. The plurality of connecting parts are connected to the at least one auxiliary anode and arrayed in an extending direction of the auxiliary anode. The busbar is configured to flow the electricity supplied to the power feeding part to the auxiliary anode via the connecting parts. The at least one ionically resistive element is arranged between the auxiliary anode and the substrate inside the plating tank and extending so as to be along the auxiliary anode. The ionically resistive element is configured to increase in resistivity of the ionically resistive element as approaching the power feeding part in an extending direction of the ionically resistive element.

With this aspect, a film thickness on the outer peripheral edge of the substrate becoming non-uniform caused by the connecting parts of the busbar having smaller resistance values as approaching the power feeding part can be suppressed.

(Aspect 2)

In the aspect 1 described above, the ionically resistive element may have a plurality of openings, and the ionically resistive element decreasing in opening rate as approaching the power feeding part in the extending direction of the ionically resistive element may cause the ionically resistive element to increase in resistivity as approaching the power feeding part in the extending direction of the ionically resistive element.

(Aspect 3)

In the aspect 1 described above, the ionically resistive element increasing in thickness as approaching the power feeding part in the extending direction of the ionically resistive element may cause the ionically resistive element to increase in resistivity as approaching the power feeding part in the extending direction of the ionically resistive element.

(Aspect 4)

In one aspect according to any of the aspects 1 to 3 described above, the aspect 4 may have a following configuration. The busbar has a joining part configured to join the power feeding part and the connecting parts, the joining part has a plurality of extending parts extending so as to be along an outer peripheral edge of the substrate, the plurality of extending parts are arranged in a frame shape, the at least one auxiliary anode includes a plurality of the auxiliary anodes, and the respective auxiliary anodes are connected to the respective extending parts via the plurality of connecting parts.

(Aspect 5)

In one aspect according to any of the aspects 1 to 4 described above, the aspect 5 may have a following configuration. The plating apparatus includes a housing portion configured to house the at least one auxiliary anode inside the housing portion, the housing portion is provided with an opening facing the substrate, and the opening of the housing portion is closed by a membrane configured to allow metal ions contained in the plating solution to pass through the membrane and restrict oxygen generated from surfaces of the auxiliary anode from passing through the membrane.

(Aspect 6)

In order to achieve the object, a plating apparatus according to one aspect of the present invention includes a plating tank, an anode, a substrate holder, at least one auxiliary anode, and a busbar. The plating tank is configured to accumulate a plating solution. The anode is arranged inside the plating tank. The substrate holder is configured to allow arranging a substrate such that the substrate is opposed to the anode inside the plating tank. The at least one auxiliary anode is arranged between the anode and the substrate inside the plating tank and extending so as to be along an outer peripheral edge of the substrate. The busbar has a power feeding part to which electricity is supplied and a plurality of connecting parts. The plurality of connecting parts are connected to the at least one auxiliary anode and arrayed in an extending direction of the auxiliary anode. The busbar is configured to flow the electricity supplied to the power feeding part to the auxiliary anode via the connecting parts. The auxiliary anode is configured such that a distance between the auxiliary anode and the substrate increases as approaching the power feeding part in an extending direction of the auxiliary anode.

With this aspect, a film thickness on the outer peripheral edge of the substrate becoming non-uniform caused by the connecting parts of the busbar having smaller resistance values as approaching the power feeding part can be suppressed.

DESCRIPTION OF EMBODIMENTS

Figure 1:
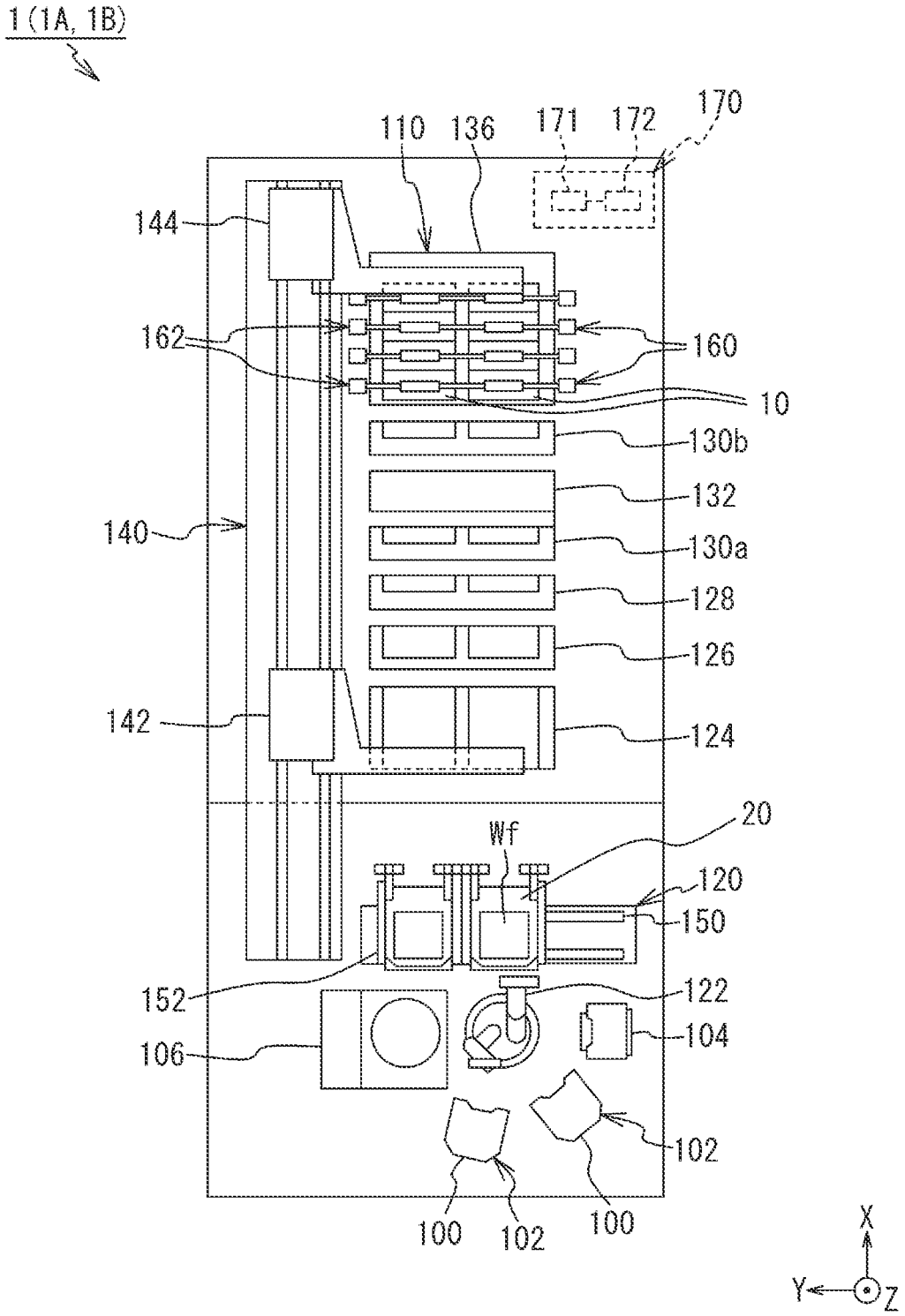
FIG. 1 is an entire layout drawing of a plating apparatus according to Embodiment 1.

The following describes an embodiment of the present invention with reference to the drawings. Note that in the following respective embodiments, an identical reference numeral is attached to an identical or corresponding constitution and a description will be appropriately omitted in some cases. The drawings are schematically illustrated to facilitate understanding of features of the embodiment, and dimensional proportions and the like of each constituent element are not necessarily the same as the actual ones. In some drawings, orthogonal coordinates of X-Y-Z are illustrated for reference. Of the orthogonal coordinates, the Z-direction corresponds to an upper side, and the −Z-direction corresponds to a lower side (the direction in which gravity acts).

Embodiment 1

First, a plating apparatus 1 according to Embodiment 1 of the present invention will be described. FIG. 1 is an entire layout drawing of the plating apparatus 1 according to this embodiment. As illustrated in FIG. 1, the plating apparatus 1 according to this embodiment includes two cassette tables 102, an aligner 104 that adjusts a position of an orientation flat, a notch, and the like of a substrate Wf in a predetermined direction, and a rinse dryer 106 that dries the substrate Wf after a plating process. On the cassette table 102, a cassette 100 that stores the substrate Wf such as a semiconductor wafer is mounted. Near the rinse dryer 106, a load/unload station 120 on which a substrate holder 20 is placed to perform attach and remove of the substrate Wf is disposed. A transfer robot 122 is a robot for transferring the substrate Wf between the cassette 100, the aligner 104, the rinse dryer 106, and the load/unload station 120.

The load/unload station 120 includes a flat plate-shaped placing plate 152 that is slidable in a lateral direction along a rail 150. Two substrate holders 20 are placed in parallel in a horizontal state on the placing plate 152. After a delivery and receipt of a substrate Wf has been performed between one of the substrate holders 20 and the transfer robot 122, the placing plate 152 is slid in the lateral direction, and a delivery and receipt of another substrate Wf is performed between the other substrate holder 20 and the transfer robot 122.

In addition, the plating apparatus 1 includes a stocker 124, a pre-wet module 126, a pre-soak module 128, a first rinse module 130*a*, a blow module 132, a second rinse module 130*b*, a plating module 110, a transfer device 140, and a control module 170. In the stocker 124, storage and temporarily placement of the substrate holders 20 are performed. In the pre-wet module 126, the substrates Wf are immersed in pure water. In the pre-soak module 128, oxidized films on surfaces of conductive layers of seed layers and the like formed on surfaces of the substrates Wf are removed by etching. In the first rinse module 130*a*, the substrates Wf after being pre-soaked are cleaned by a cleaning liquid (such as pure water) together with the substrate holders 20. In the blow module 132, a liquid draining of the substrates Wf after being cleaned is performed. In the second rinse module 130*b*, the substrates Wf after the plating process are cleaned by the cleaning liquid together with the substrate holders 20.

The plating module 110 is configured, for example, so as to house a plurality of plating tanks 10 inside an overflow tank 136. Each plating tank 10 houses one substrate Wf inside, and is configured to immerse the substrate Wf in a plating solution held inside to perform a copper plating and the like on a surface of the substrate Wf.

The transfer device 140 is a transfer device that employs, for example, a linear motor system, and transfers the substrate holders 20 between respective devices of the plating apparatus 1 together with the substrates Wf. The transfer device 140 according to this embodiment includes, for example, a first transfer device 142 and a second transfer device 144. The first transfer device 142 transfers the substrates Wf between the load/unload station 120, the stocker 124, the pre-wet module 126, the pre-soak module 128, the first rinse module 130*a*, and the blow module 132. The second transfer device 144 transfers the substrates Wf between the first rinse module 130*a*, the second rinse module 130*b*, the blow module 132, and the plating module 110. Note that the plating apparatus 1 need not include the second transfer device 144, and may include the first transfer device 142 alone.

On both sides of the overflow tank 136, a paddle driving portion 160 and a paddle driven portion 162 that drive a paddle that is positioned inside each plating tank 10 and stirs the plating solution in the plating tank 10 are arranged.

The control module 170 is configured to control an operation of the plating apparatus 1. Specifically, the control module 170 according to this embodiment includes a microcomputer. The microcomputer includes a Central Processing Unit (CPU) 171 as a processor, a storage device 172 as a non-transitory storage medium, and the like. The control module 170 controls a controlled device of the plating apparatus 1 by the CPU 171 operating according to commands of a program stored in the storage device 172.

One example of a sequence of a plating process according to the plating apparatus 1 will be described. First, the transfer robot 122 grips one substrate Wf from the cassette 100 mounted to the cassette table 102 and transfers the substrate Wf to the aligner 104. The aligner 104 adjusts a position of an orientation flat, a notch, and the like in a predetermined direction. The substrate Wf whose position has been adjusted in the predetermined direction is transferred to the load/unload station 120 by the transfer robot 122.

In the load/unload station 120, the two substrate holders 20 housed in the stocker 124 are simultaneously griped by the first transfer device 142 of the transfer device 140, and transferred to the load/unload station 120. Subsequently, the two substrate holders 20 are simultaneously placed horizontally on the placing plate 152 of the load/unload station 120. In this state, the transfer robot 122 transfers the substrates Wf to the respective substrate holders 20, and the transferred substrates Wf are held by the substrate holders 20.

Next, the two substrate holders 20 holding the substrates Wf are simultaneously griped by the first transfer device 142 of the transfer device 140, and housed in the pre-wet module 126. Next, the substrate holders 20 holding the substrates Wf processed in the pre-wet module 126 are transferred to the pre-soak module 128 by the first transfer device 142, and the oxidized film on the substrate Wf is etched by the pre-soak module 128. Subsequently, the substrate holders 20 holding the substrates Wf are transferred to the first rinse module 130*a*, and the surfaces of the substrates Wf are water-cleaned with pure water housed in the first rinse module 130*a*.

The substrate holders 20 holding the substrates Wf after being water-cleaned are transferred from the first rinse module 130*a* to the plating module 110 by the second transfer device 144, and are housed in the plating tanks 10. The second transfer device 144 repeatedly performs the above-described process, and sequentially houses the substrate holders 20 holding the substrates Wf into the respective plating tanks 10 of the plating module 110.

In each plating tank 10, a plating voltage is applied between an anode and the substrate Wf in the plating tank 10, and a plating process is performed on the surface of the substrate Wf. In the plating process, the plating solution in the plating tank 10 may be stirred by the paddle being driven by the paddle driving portion 160 and the paddle driven portion 162. However, the configuration of the plating apparatus 1 is not limited to this, and for example, the plating apparatus 1 may have a configuration without the paddle, the paddle driving portion 160, or the paddle driven portion 162.

After the plating process is performed, the two substrate holders 20 holding the substrates Wf after the plating process are simultaneously griped by the second transfer device 144, transferred to the second rinse module 130*b*, and immersed in pure water housed in the second rinse module 130*b* to clean the surfaces of the substrates Wf with the pure water. Next, the substrate holders 20 are transferred to the blow module 132 by the second transfer device 144, and water droplets attached to the substrate holders 20 are removed by air spray and the like. Afterwards, the substrate holders 20 are transferred to the load/unload station 120 by the first transfer device 142.

In the load/unload station 120, the substrates Wf after being processed are griped by the transfer robot 122 from the substrate holders 20, and transferred to the rinse dryer 106. The rinse dryer 106 dries the substrates Wf after the plating process. The dried substrates Wf are returned to the cassette 100 by the transfer robot 122.

Note that, the configuration of the plating apparatus 1 described in the above FIG. 1 is merely an example, and the configuration of the plating apparatus 1 is not limited to the configuration in FIG. 1.

Subsequently, details of a peripheral configuration of the plating tank 10 in the plating apparatus 1 will be described. Since the plurality of plating tanks 10 according to this embodiment have the identical configuration, the peripheral configuration of one plating tank 10 will be described.

Figure 2:
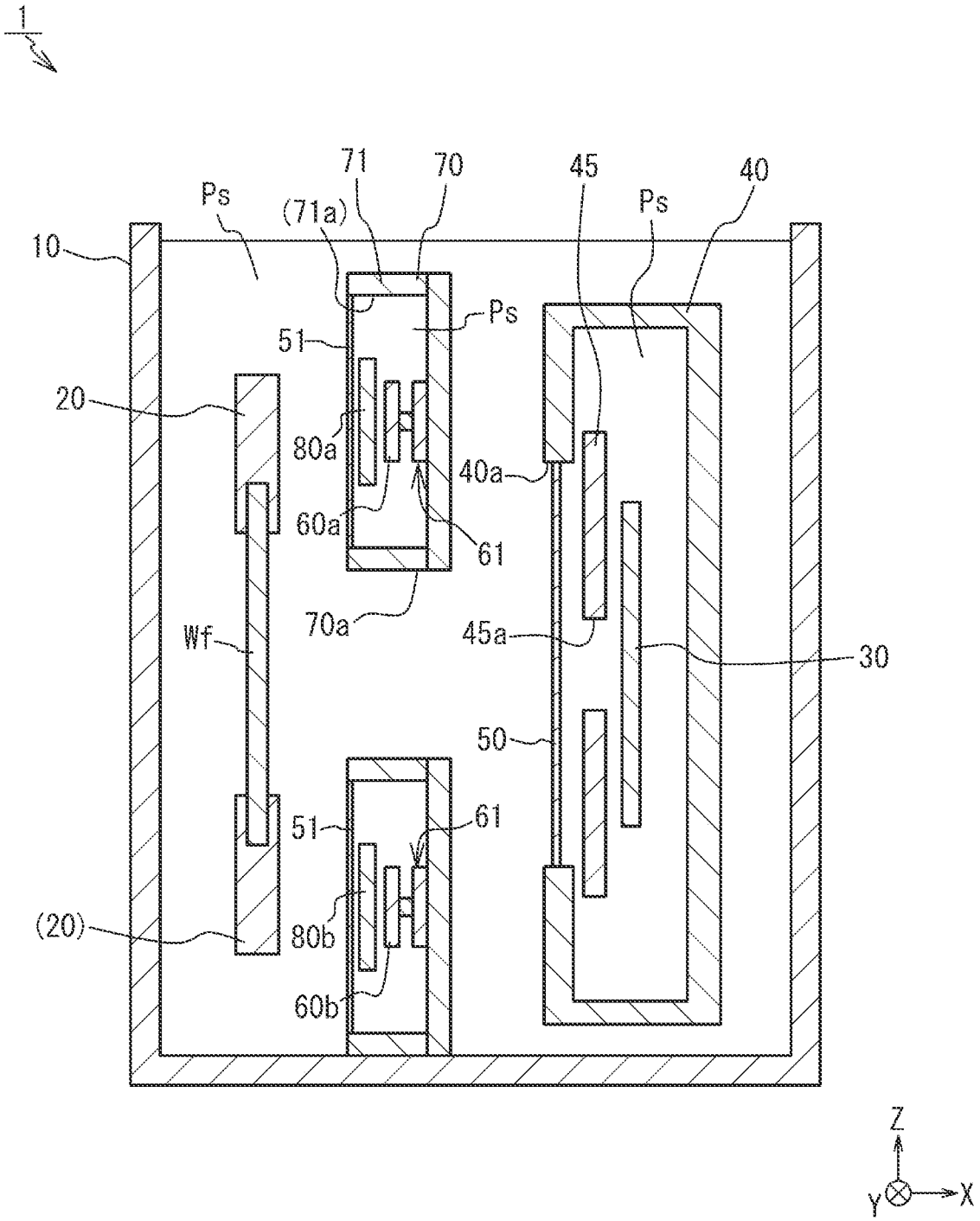
FIG. 2 is a schematic cross-sectional view illustrating a peripheral configuration of one plating tank in the plating apparatus according to Embodiment 1.

FIG. 2 is a schematic cross-sectional view illustrating the peripheral configuration of one plating tank 10 in the plating apparatus 1 according to this embodiment. The plating apparatus 1 illustrated in FIG. 2 is, for example, a type of plating apparatus (that is, a dip type plating apparatus) that sets a surface direction (a direction along the surface) of the substrate Wf in the vertical direction and immerses the substrate Wf in a plating solution Ps.

However, a specific example of the plating apparatus 1 is not limited to this. Another example of the plating apparatus 1 may be a type of plating apparatus (that is, a cup type plating apparatus) that sets the surface direction of the substrate Wf in a horizontal direction and immerses the substrate Wf in the plating solution Ps.

As illustrated in FIG. 2, the plating tank 10 may be configured of a container with a bottom and having an opening in an upper portion. Inside the plating tank 10, the plating solution Ps is accumulated. It is only necessary for the plating solution Ps to be a solution including ions of a metallic element for constituting a plating film, and a specific example of the plating solution Ps is not particularly limited. In this embodiment, a copper plating process is used as an example of the plating process, and a copper sulfate solution is used as an example of the plating solution Ps.

The plating apparatus 1 includes an anode 30 inside the plating tank 10. The anode 30 is electrically connected to a power source. A specific type of the anode 30 is not particularly limited, and it may be an insoluble anode or may be a soluble anode. In this embodiment, an insoluble anode is used as an example of the anode 30. A specific type of the insoluble anode is not particularly limited, and platinum, iridium oxide, and the like can be used.

The plating apparatus 1 may include, as illustrated in FIG. 2, an anode box 40, a membrane 50 and an anode mask 45 inside the plating tank 10. The anode box 40 is a member (housing member) for internally housing the anode 30. In a portion opposed to the substrate Wf of the anode box 40, an opening 40*a* is provided. The membrane 50 is disposed so as to obstruct the opening 40*a*. Inside the anode box 40, the plating solution Ps is accumulated.

The membrane 50 is constituted of a membrane that allows metal ions (such as copper ions in the copper sulfate) contained in the plating solution Ps to pass through the membrane and restrict oxygen generated from the surface of the anode 30 from passing through the membrane. As the membrane 50, a neutral membrane can be used as an example.

According to this embodiment, the anode 30 is housed inside the anode box 40 as described above, and the opening 40*a* of the anode box 40 is closed by the membrane 50. Thus, even in a hypothetical case where oxygen generates from the surface of the anode 30 in the plating process, an invasion of the generated oxygen into the plating solution Ps outside the anode box 40 can be suppressed. Therefore, a deterioration of a plating quality of the substrate Wf caused by the oxygen having invaded the plating solution Ps outside the anode box 40 can be suppressed.

The anode mask 45 is arranged between the anode 30 and the substrate Wf. Specifically, the anode mask 45 according to this embodiment is arranged inside the anode box 40. In the center of the anode mask 45, a hole 45*a* that allows ions and the like moving between the anode 30 and the substrate Wf to pass through is provided.

The substrate holder 20 is a member for holding the substrate Wf as a cathode. The substrate holder 20 is configured to allow arranging the substrate Wf such that the substrate Wf is opposed to the anode 30 inside the plating tank 10. Specifically, the substrate holder 20 holds the substrate Wf such that a surface of the substrate Wf is opposed to the anode 30 in the plating process of the substrate Wf. More specifically, the substrate holder 20 according to this embodiment holds the substrate Wf such that a surface direction of the substrate Wf is set in the vertical direction. By the plating process, a plating film is formed on a surface to be plated (a surface opposed to the anode 30) of the substrate Wf.

Figure 3:
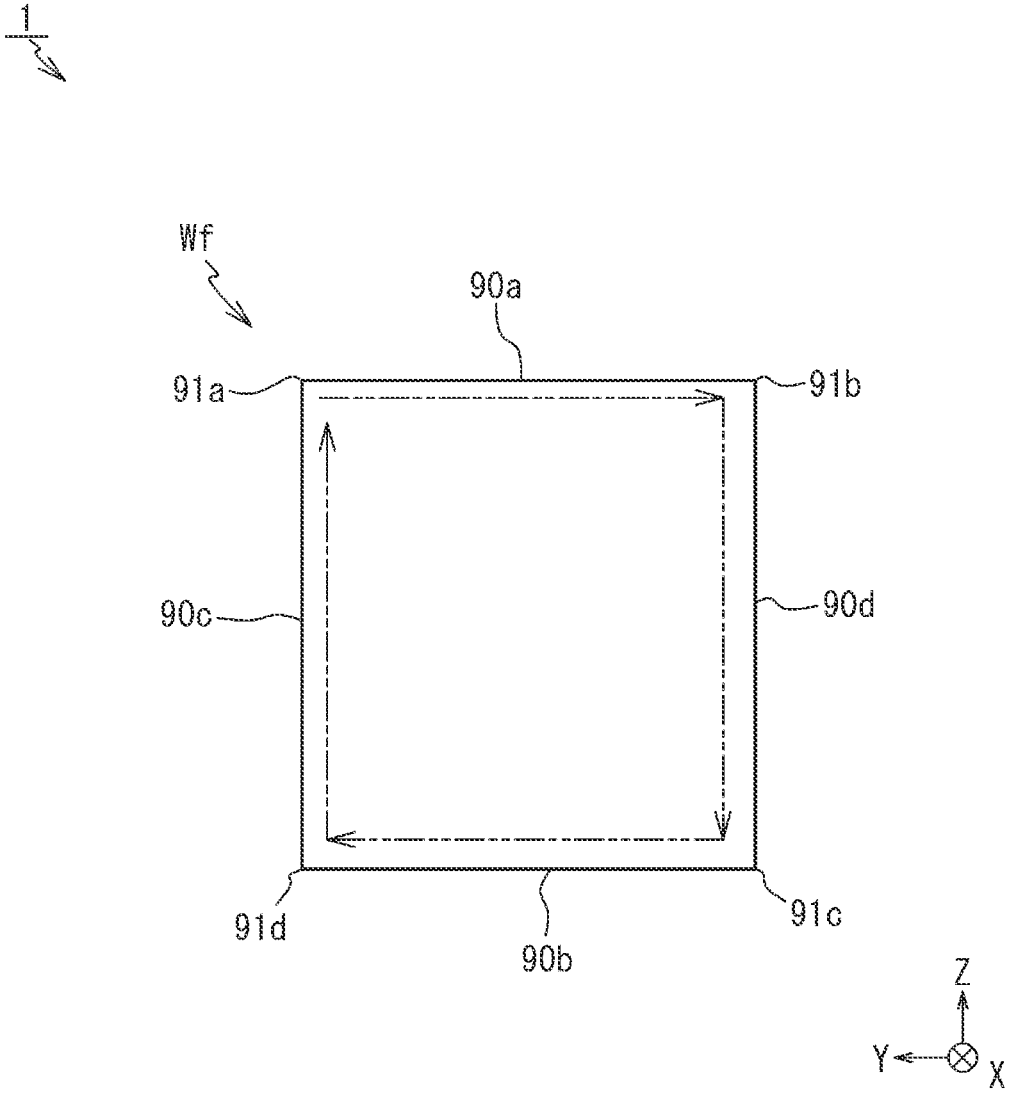
FIG. 3 is a schematic front view of a substrate according to Embodiment 1.

FIG. 3 is a schematic front view of the substrate Wf. Specifically, FIG. 3 illustrates a state where the substrate Wf is viewed from the normal direction of the surface to be plated of the substrate Wf. A specific shape of the substrate Wf is not particularly limited, and the substrate Wf may be a polygonal substrate having a plurality of sides as illustrated in FIG. 3. The number of sides of the substrate Wf is not particularly limited, and it may be three, four, five, or more.

The number of sides of the substrate Wf according to this embodiment is four, as an example. That is, the substrate Wf according to this embodiment is a rectangular-shaped polygonal substrate having a side 90*a*, a side 90*b*, a side 90*c*, and a side 90*d*. The side 90*a* and the side 90*b* are opposed to one another, and the side 90*c* and the side 90*d* are opposed to one another. A corner portion 91*a* is disposed between the side 90*a* and the side 90*c*, a corner portion 91*b* is disposed between the side 90*a* and the side 90*d*, a corner portion 91*c* is disposed between the side 90*b* and the side 90*d*, and a corner portion 91*d* is disposed between the side 90*b* and the side 90*c*.

As an example, lengths of the respective sides of the substrate Wf according to this embodiment are equal to one another. That is, the substrate Wf according to this embodiment has a square shape in front view. However, the configuration of the substrate Wf is not limited to this, and for example, the lengths of the respective sides of the substrate Wf may be different from one another.

In this embodiment, electricity is supplied from the respective sides of the substrate Wf to the substrate Wf. Specifically, the substrate Wf according to this embodiment is supplied with electricity from the respective sides of the substrate Wf via a contact member (not illustrated). However, it is not limited to this configuration, and for example, the electricity supplied to the substrate Wf can be supplied from two sides opposed to one another of the substrate Wf.

With reference to FIG. 2 again, the plating apparatus 1 according to this embodiment includes at least one auxiliary anode inside the plating tank 10. That is, the plating apparatus 1 may include only one auxiliary anode, and may include a plurality of auxiliary anodes. The plating apparatus 1 according to this embodiment, as one example, includes a plurality of auxiliary anodes (auxiliary anodes 60*a*, 60*b*, 60*c*, 60*d*).

The auxiliary anodes 60*a* to 60*d* are arranged in a portion between the anode 30 and the substrate Wf inside the plating tank 10. Specifically, the auxiliary anodes 60*a* to 60*d* illustrated in FIG. 2 are arranged in a portion between the substrate Wf and an intermediate mask 70 described later. The auxiliary anodes 60*a* to 60*d* according to this embodiment are housed inside a housing portion 71 described later.

A specific type of the auxiliary anodes 60*a* to 60*d* is not particularly limited, and it may be an insoluble anode or a soluble anode. In this embodiment, an insoluble anode is used as an example of the auxiliary anodes 60*a* to 60*d*. A specific type of the insoluble anode is not particularly limited, and various kinds of metals, such as platinum, iridium oxide, and titanium can be used. As an example, the auxiliary anodes 60*a* to 60*d* according to this embodiment are configured of plate-shaped titanium, and iridium oxide is coated on a surface of the titanium.

Figure 4:
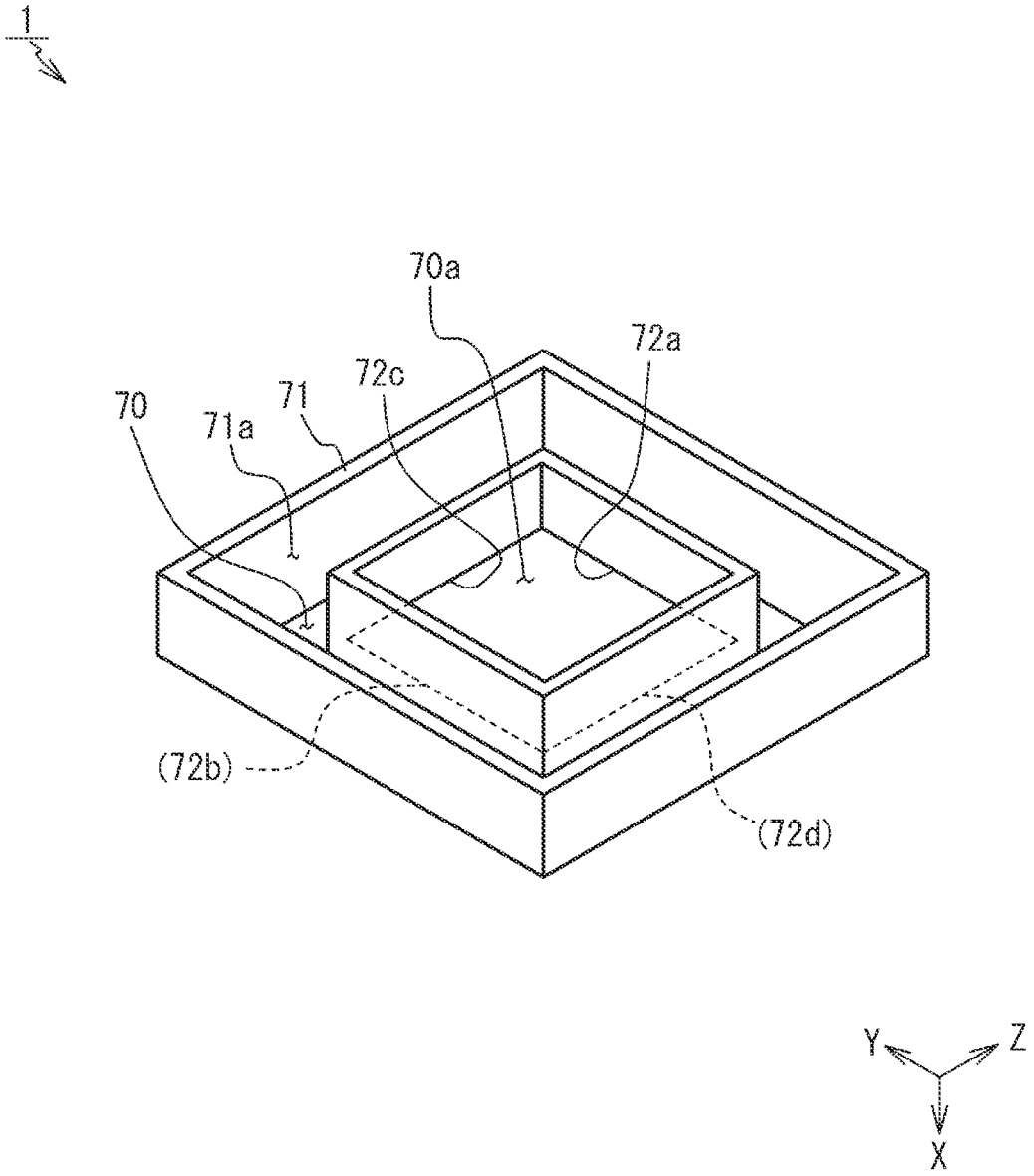
FIG. 4 is a schematic perspective view of a peripheral configuration of an intermediate mask according to Embodiment 1.

With reference to FIG. 2 again, the plating apparatus 1 may include the intermediate mask 70 and a membrane 51. FIG. 4 is a schematic perspective view of a peripheral configuration of the intermediate mask 70. With reference to FIG. 2 and FIG. 4, the intermediate mask 70 is arranged between the anode 30 and the substrate Wf. Specifically, the intermediate mask 70 according to this embodiment is arranged between the anode box 40 and the substrate Wf. In the center of the intermediate mask 70, a hole 70*a* that allows ions to move through is provided.

In this embodiment, as an example, the hole 70*a* of the intermediate mask 70 is a polygonal hole, and has a plurality of sides (sides 72*a*, 72*b*, 72*c*, 72*d*) corresponding to the respective plurality of sides of the substrate Wf. Specifically, the side 72*a* corresponds to the side 90*a* of the substrate Wf, the side 72*b* corresponds to the side 90*b* of the substrate Wf, the side 72*c* corresponds to the side 90*c* of the substrate Wf, and the side 72*d* corresponds to the side 90*d* of the substrate Wf. The side 72*a* extends in the extending direction of the side 90*a*, the side 72*b* extends in the extending direction of the side 90*b*, the side 72*c* extends in the extending direction of the side 90*c*, and the side 72*d* extends in the extending direction of the side 90*d*.

On a surface opposed to the substrate Wf of the intermediate mask 70 according to this embodiment, the housing portion 71 for housing the auxiliary anodes 60*a* to 60*d* is disposed. The housing portion 71 is provided with an opening 71*a* that is opened so as to face the substrate Wf.

The membrane 51 obstructs the opening 71*a* of the housing portion 71. Inside the housing portion 71, the plating solution Ps is accumulated. As the membrane 51, one similar to the above-described membrane 50 can be used.

That is, the membrane 51 according to this embodiment is constituted of a membrane that allows metal ions (such as copper ions in the copper sulfate) contained in the plating solution Ps to pass through the membrane and restrict the oxygen generated from the surfaces of the auxiliary anode from passing through the membrane. As the membrane 51, a neutral membrane can be used as an example.

According to this embodiment, since the auxiliary anodes 60*a* to 60*d* are housed in the housing portion 71 as described above, and the opening 71*a* of the housing portion 71 is closed by the membrane 51, even in a hypothetical case where oxygen generates from the surfaces of the auxiliary anodes 60*a* to 60*d* in the plating process, an invasion of the generated oxygen into the plating solution Ps outside the housing portion 71 can be suppressed. Therefore, a deterioration of the plating quality of the substrate Wf caused by the oxygen having invaded the plating solution Ps outside the housing portion 71 can be suppressed.

With reference to FIG. 2, the plating apparatus 1 according to this embodiment includes a busbar 61 and at least one ionically resistive element inside the plating tank 10. The plating apparatus 1 according to this embodiment, as an example, includes a plurality of ionically resistive elements (ionically resistive elements 80*a*, 80*b*, 80*c*, 80*d*).

Figure 5:
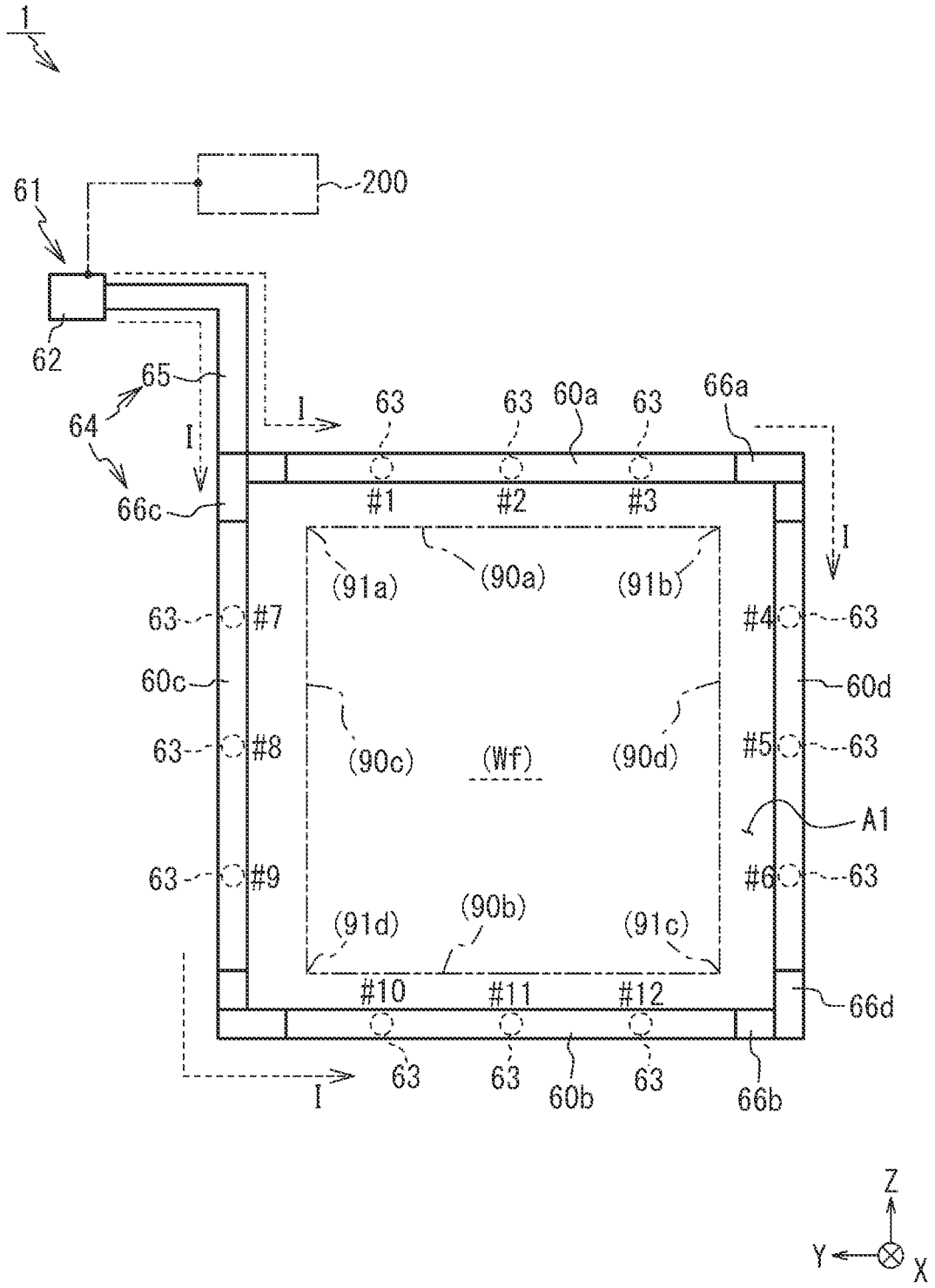
FIG. 5 is a schematic front view of a busbar and auxiliary anodes according to Embodiment 1.
Figure 6:
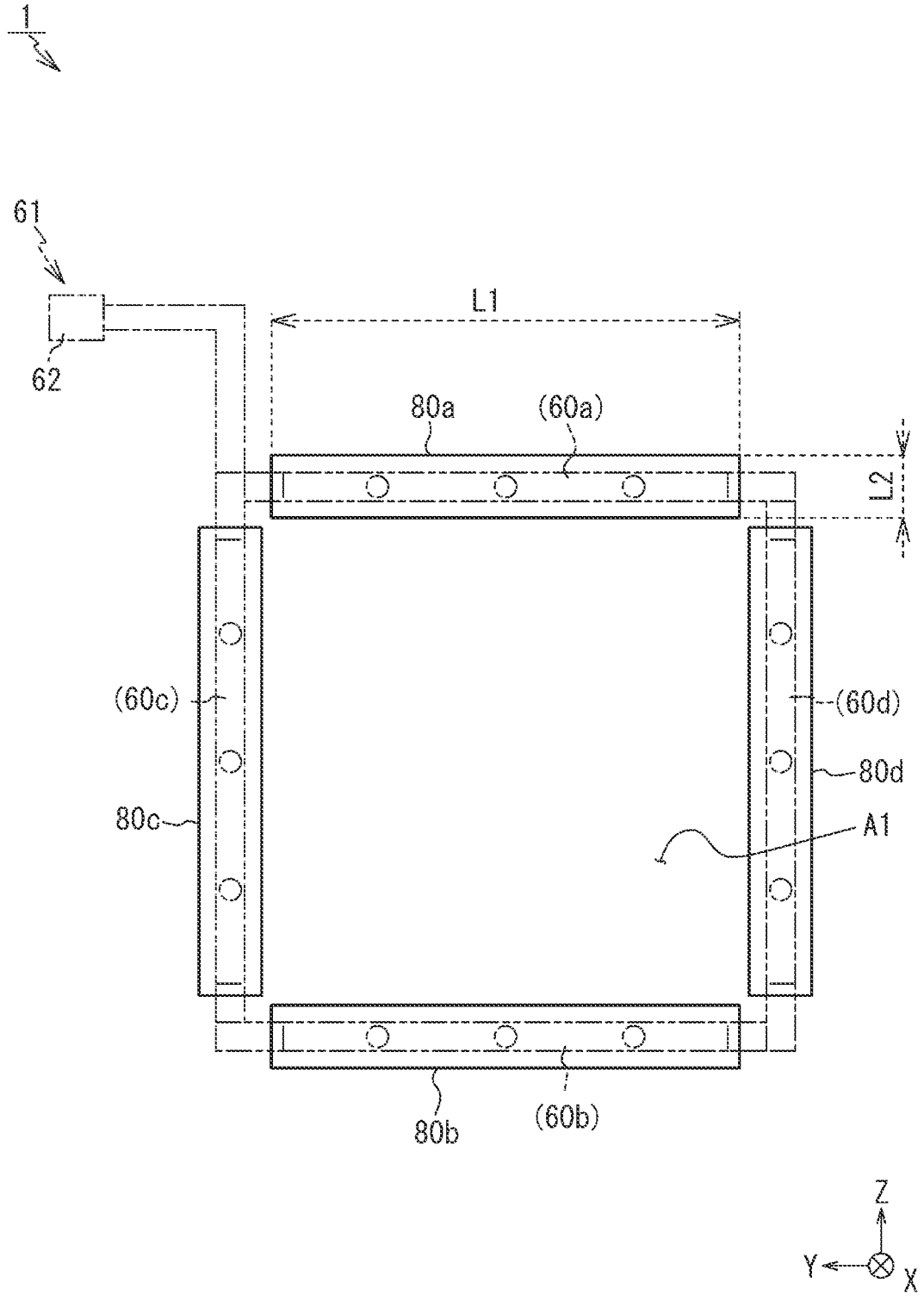
FIG. 6 is a schematic front view of ionically resistive elements according to Embodiment 1.
Figure 7:
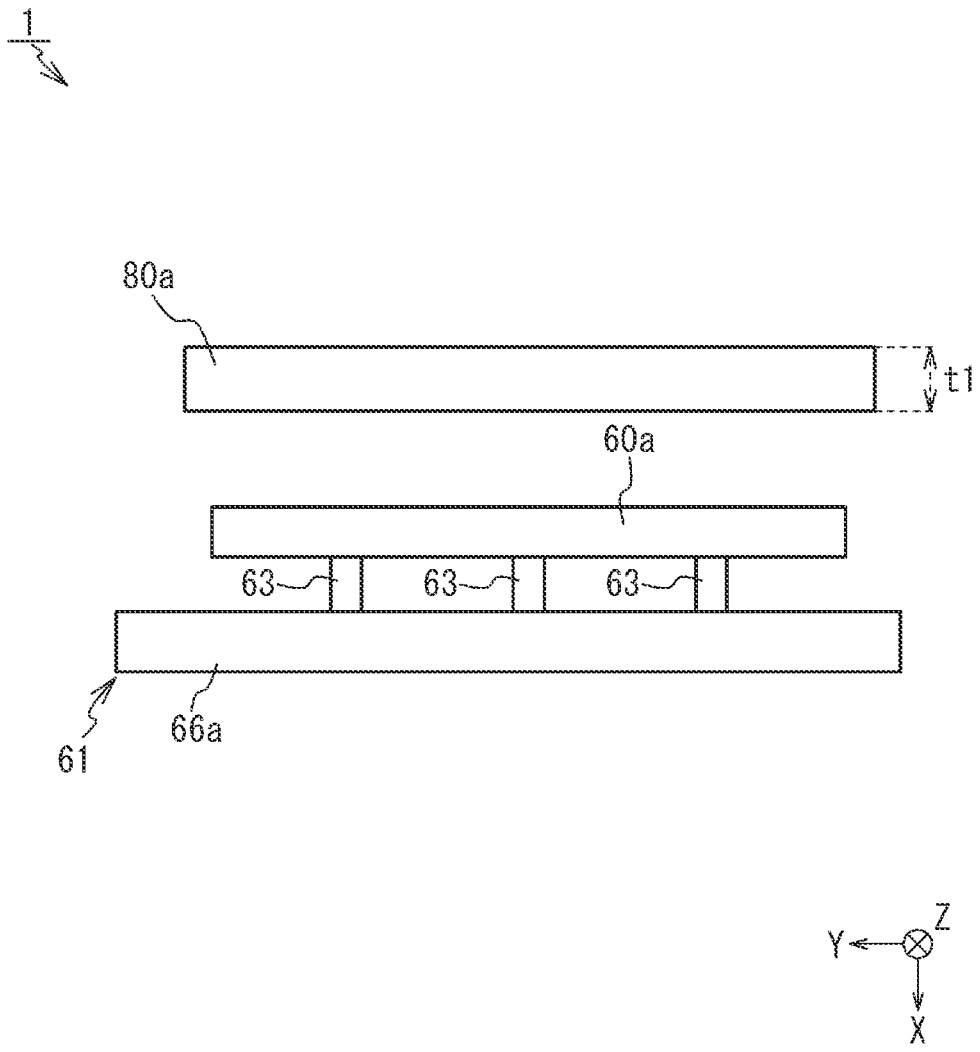
FIG. 7 is a schematic side view of a peripheral configuration of an auxiliary anode according to Embodiment 1.

FIG. 5 is a schematic front view of the busbar 61 and the auxiliary anodes 60*a* to 60*d*. In FIG. 5, for reference, the substrate Wf is also indicated by two-dot chain lines. In addition, in FIG. 5, a direction in which electricity flows (that is, a current direction) is illustrated by "I." FIG. 6 is a schematic front view of the ionically resistive elements 80*a* to 80*d*. In FIG. 6, for reference, the busbar 61 and the auxiliary anodes 60*a* to 60*d* are also indicated by two-dot chain lines. FIG. 7 is a schematic side view of a peripheral configuration of the auxiliary anode 60*a*.

As illustrated in FIG. 5, the number of the auxiliary anodes 60*a* to 60*d* according to this embodiment corresponds to the number of sides of the substrate Wf. The auxiliary anodes 60*a* to 60*d* are arranged so as to surround the peripheral area of a predetermined spatial region A1. Specifically, the auxiliary anodes 60*a* to 60*d* according to this embodiment are arranged so as to surround an outer peripheral edge of the substrate Wf when viewed from the normal direction of the surface to be plated of the substrate Wf. In this embodiment, the spatial region A1 is a region in a side of the anode 30 with respect to the substrate Wf and the region in a side of the substrate Wf with respect to the anode 30.

The auxiliary anodes 60*a* to 60*d* extend so as to be along the outer peripheral edges of the substrate Wf. Specifically, the respective auxiliary anodes 60*a* to 60*d* according to this embodiment are arranged so as to correspond to the respective sides of the substrate Wf, and extend in the extending directions of the respective sides of the substrate Wf.

More specifically, as illustrated in FIG. 5, the auxiliary anode 60*a* corresponds to the side 90*a* of the substrate Wf, and extends in the extending direction (Y-direction) of the side 90*a*. The auxiliary anode 60*b* corresponds to the side 90*b*, and extends in the extending direction (Y-direction) of the side 90*b*. The auxiliary anode 60*c* corresponds to the side 90*c*, and extends in the extending direction (Z-direction) of the side 90*c*. The auxiliary anode 60*d* corresponds to the side 90*d*, and extends in the extending direction (Z-direction) of the side 90*d*.

With reference to FIG. 5, the busbar 61 is a member for supplying electricity to the auxiliary anodes 60*a* to 60*d*. A specific configuration of the busbar 61 is not particularly limited, and the busbar 61 according to this embodiment is constituted of, for example, a material having satisfactory electric conductivity, such as titanium. As an example, the busbar 61 according to this embodiment is constituted of a flat plate-shaped member. The busbar 61 may be coated by a coating material to effectively suppress corrosion by the plating solution Ps.

The busbar 61 according to this embodiment includes a power feeding part 62, a plurality of connecting parts 63, and a joining part 64. The power feeding part 62 is a part configured to be electrically connected to a power source 200 and supplied with electricity from the power source 200.

With reference to FIG. 5 and FIG. 7, the connecting parts 63 are parts (that is, connection bosses) that are connected to the auxiliary anodes 60*a* to 60*d*. Specifically, the connecting parts 63 according to this embodiment are in a projection shape and join the auxiliary anodes 60*a* to 60*d* and extending parts 66*a* to 66*d* described later of the joining part 64. In FIG. 5, the numbers of #1 to #12 are assigned to the plurality of connecting parts 63. As illustrated in FIG. 5, the plurality of connecting parts 63 are arrayed in the extending directions of the auxiliary anodes 60*a* to 60*d* at intervals from adjacent connecting parts 63.

The joining part 64 is a part configured to join the power feeding part 62 and the connecting parts 63. As illustrated in FIG. 5, the joining part 64 according to this embodiment includes an introduction part 65 and the extending parts 66*a* to 66*d*. The introduction part 65 is a part configured to join the extending parts 66*a* to 66*d* and the power feeding part 62 and introduce the electricity in the power feeding part 62 into the extending parts 66*a* to 66*d*.

The extending parts 66*a* to 66*d* extend so as to be along the auxiliary anodes 60*a* to 60*d*. Specifically, the extending part 66*a* extends in the extending direction of the auxiliary anode 60*a*, and the extending part 66*b* extends in the extending direction of the auxiliary anode 60*b*. The extending part 66*c* extends in the extending direction of the auxiliary anode 60*c*, and the extending part 66*d* extends in the extending direction of the auxiliary anode 60*d*.

The extending part 66*a* and the extending part 66*d* are electrically connected in series. The extending part 66*c* and the extending part 66*b* are electrically connected in series. Then, the extending parts 66*a*, 66*d* and the extending parts 66*c*, 66*b* are electrically connected in parallel. As a result, the auxiliary anode 60*a* and the auxiliary anode 60*c* are arranged so as to be electrically parallel, and the auxiliary anode 60*d* and the auxiliary anode 60*b* are arranged so as to be electrically parallel.

The extending parts 66*a* to 66*d* are arranged so as to surround the peripheral area of the predetermined spatial region A1. Specifically, the extending parts 66*a* to 66*d* according to this embodiment are arranged so as to surround the outer peripheral edge of the substrate Wf when viewed from the normal direction of the surface to be plated of the substrate Wf. The extending parts 66*a* to 66*d* according to this embodiment are mutually joined and arranged in a frame shape. Specifically, as an example, the extending parts 66*a* to 66*d* according to this embodiment are in a polygonal (rectangular as an example in this embodiment) frame shape.

The respective auxiliary anodes 60*a* to 60*d* are connected to the respective extending parts 66*a* to 66*d* via the plurality of connecting parts 63. Specifically, the auxiliary anode 60*a* is connected to the extending part 66*a* via the connecting parts 63 of #1 to #3. The auxiliary anode 60*b* is connected to the extending part 66*b* via the connecting parts 63 of #10 to #12. The auxiliary anode 60*c* is connected to the extending part 66*c* via the connecting parts 63 of #7 to #9. The auxiliary anode 60*d* is connected to the extending part 66*d* via the connecting parts 63 of #4 to #6.

The electricity supplied from the power source 200 to the busbar 61 via the power feeding part 62 flows through the connecting parts 63 after flowing through the joining part 64 and is supplied to the auxiliary anodes 60*a* to 60*d*. Specifically, the electricity supplied to the power feeding part 62 flows into each of the extending part 66*a* and the extending part 66*c* of the joining part 64 after flowing through the introduction part 65 of the joining part 64. The electricity that has flowed through the extending part 66*a* flows through the extending part 66*d*, and the electricity that has flowed through the extending part 66*c* flows through the extending part 66*b*. The electricity in the extending part 66*a* flows to the auxiliary anode 60*a* via the connecting parts 63, and the electricity in the extending part 66*b* flows to the auxiliary anode 60*b* via the connecting parts 63. The electricity in the extending part 66*c* flows to the auxiliary anode 60*c* via the connecting parts 63, and the electricity in the extending part 66*d* flows to the auxiliary anode 60*d* via the connecting parts 63.

Here, the connecting parts 63 of the busbar 61 have smaller resistance values at a position closer to the power feeding part 62 (conversely, the farther from the power feeding part 62, the larger). Note that "closer to the power feeding part 62" specifically means that "an electrical distance from the power feeding part 62 is short."

For example, to list one example of the resistance values of the respective connecting parts 63 when a current of 100 (mA) is applied to the busbar 61, they are 8 (mΩ) for #1, 10 (mΩ) for #2, 12 (mΩ) for #3, 12 (mΩ) for #4, 13 (mΩ) for #5, 15 (mΩ) for #6, 8 (mΩ) for #7, 10 (mΩ) for #8, 12 (mΩ) for #9, 13 (mΩ) for #10, 14 (mΩ) for #11, and 15 (mΩ) for #12.

Thus, as a result of the connecting parts 63 of the busbar 61 having smaller resistance values as approaching the power feeding part 62, the amount of electricity (that is, a current value) flowing from the busbar 61 to the auxiliary anodes 60*a* to 60*d* in the plating process tends to increase as approaching the power feeding part 62. In view of this, in a hypothetical case where the ionically resistive elements 80*a* to 80*d* described later are not disposed, a film thickness on the outer peripheral edge of the substrate Wf possibly becomes thicker at a position closer to the power feeding part 62. Specifically, with reference to FIG. 3, the film thickness at the periphery of the corner portion 91*a* of the substrate Wf possibly becomes the thickest. In order to deal with the problem, in this embodiment, the ionically resistive elements 80*a* to 80*d* described below are included.

With reference to FIG. 2, FIG. 6, and FIG. 7, the ionically resistive element (ionically resistive elements 80*a* to 80*d*) is a member that functions as resistance against the movement of ions in the plating solution Ps, and specifically, it is constituted of a member having a higher electrical resistance than the electrical resistance of the plating solution Ps. As long as the ionically resistive elements 80*a* to 80*d* have the function, a specific material of the ionically resistive elements 80*a* to 80*d* is not particularly limited. However, for example, a material having high corrosion resistance against the plating solution Ps, such as ceramic, is preferably used.

The ionically resistive elements 80*a* to 80*d* are arranged between the auxiliary anodes 60*a* to 60*d* and the substrate Wf inside the plating tank 10. Specifically, as illustrated in FIG. 2, the ionically resistive elements 80*a* to 80*d* according to this embodiment are arranged inside the housing portion 71, and specifically, arranged in regions between the auxiliary anodes 60*a* to 60*d* and the membrane 51. The ionically resistive elements 80*a* to 80*d* are mounted inside the plating tank 10 by predetermined mounting members (not illustrated), The ionically resistive elements 80*a* to 80*d* have a "thickness t1 (specifically, a length (mm) in a direction heading for the substrate Wf from the anode 30)" that is not particularly limited but has a value that does not cause the ionically resistive elements 80*a* to 80*d* to come into contact with the membrane 51 or the auxiliary anodes 60*a* to 60*d*. That is, the ionically resistive elements 80*a* to 80*d* according to this embodiment are arranged so as to have space from the membrane 51 and also have space from the auxiliary anodes 60*a* to 60*d*. As illustrated in FIG. 7, as an example, the thickness t1 of the ionically resistive elements 80*a* to 80*d* according to this embodiment is the same in value (that is, uniform) over the extending directions of the ionically resistive elements 80*a* to 80*d*.

As illustrated in FIG. 6, the ionically resistive elements 80*a* to 80*d* extend so as to be along the auxiliary anodes 60*a* to 60*d*. Specifically, the ionically resistive element 80*a* extends in the extending direction of the auxiliary anode 60*a*, and the ionically resistive element 80*b* extends in the extending direction of the auxiliary anode 60*b*. The ionically resistive element 80*c* extends in the extending direction of the auxiliary anode 60*c*, and the ionically resistive element 80*d* extends in the extending direction of the auxiliary anode 60*d*.

Moreover, the ionically resistive element 80*a* is arranged so as to be opposed to the auxiliary anode 60*a*, and the ionically resistive element 80*b* is arranged so as to be opposed to the auxiliary anode 60*b*. The ionically resistive element 80*c* is arranged so as to be opposed to the auxiliary anode 60*c*, and the ionically resistive element 80*d* is arranged so as to be opposed to the auxiliary anode 60*d*. These ionically resistive elements 80*a* to 80*d* are arranged so as to surround the peripheral area of the spatial region A1. Specifically, the ionically resistive elements 80*a* to 80*d* according to this embodiment are arranged so as to surround the outer peripheral edge of the substrate Wf when viewed from the normal direction of the surface to be plated of the substrate Wf.

With reference to FIG. 6, the ionically resistive elements 80*a* to 80*d* have a length (L1) in the extending directions that is not particularly limited. The length (L1) may be longer than, may be shorter than, or may be the same as the length in the extending directions of the auxiliary anodes 60*a* to 60*d*. In this embodiment, as an example, the length (L1) of the ionically resistive elements 80*a* to 80*d* is in a range of 80% or more and 130% or less of the length of the auxiliary anodes 60*a* to 60*d*, and specifically, in a range of 90% or more and 120% or less of the length of the auxiliary anodes 60*a* to 60*d*. The length (L1) of the ionically resistive elements 80*a* to 80*d* is preferably the same as the length of the auxiliary anodes 60*a* to 60*d* or longer than the length of the auxiliary anodes 60*a* to 60*d*.

The ionically resistive elements 80*a* to 80*d* have a width (L2) that is not particularly limited. The width (L2) may be longer than, may be shorter than, or may be the same as the width of the auxiliary anodes 60*a* to 60*d*. In this embodiment, as an example, the width (L2) of the ionically resistive elements 80*a* to 80*d* is in a range of 80% or more and 120% or less of the width of the auxiliary anodes 60*a* to 60*d*.

Figure 8:
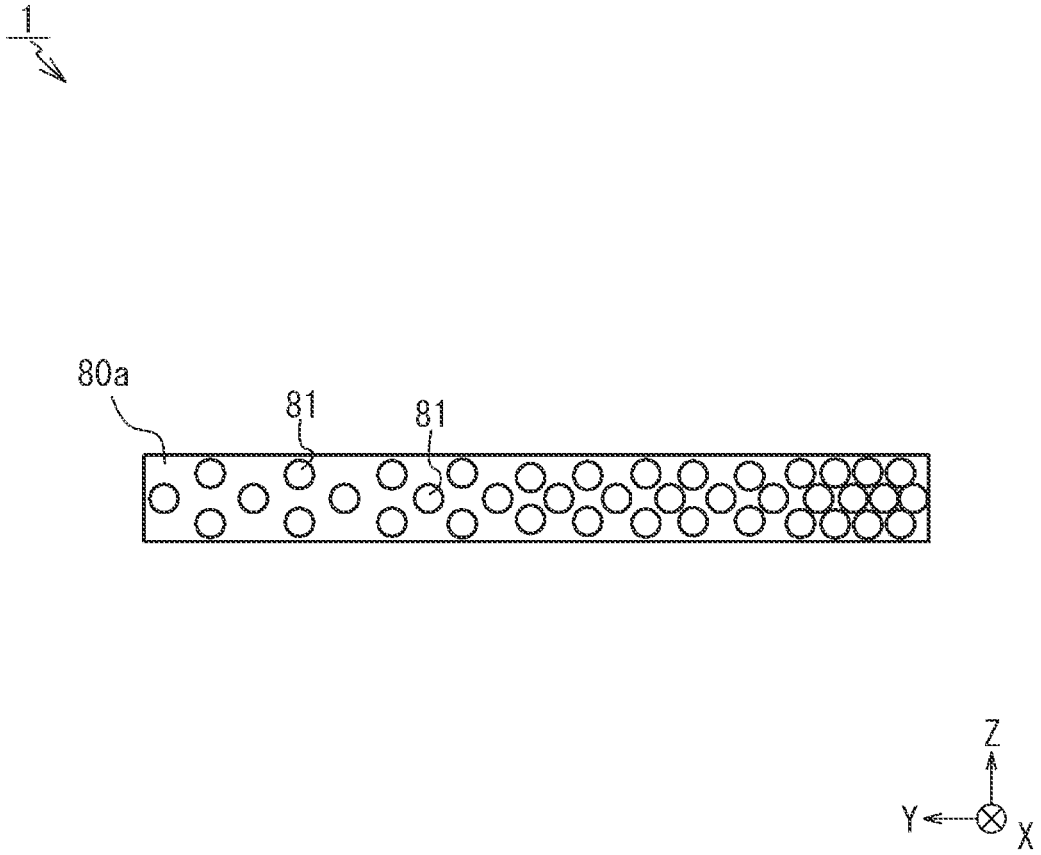
FIG. 8 is a schematic front view of an ionically resistive element according to Embodiment 1.

FIG. 8 is a schematic front view of one ionically resistive element (specifically, the ionically resistive element 80*a*) among the plurality of ionically resistive elements 80*a* to 80*d*. With reference to FIG. 6 and FIG. 8, the ionically resistive elements 80*a* to 80*d* are configured to increase in resistivity (Q·cm) of the ionically resistive elements 80*a* to 80*d* as approaching the power feeding part 62 in the extending directions of the ionically resistive elements 80*a* to 80*d*. Specifically, the resistivity of the ionically resistive element 80*a* becomes higher toward the Y-direction in FIG. 6. The resistivity of the ionically resistive element 80*b* becomes higher toward the Y-direction in FIG. 6. The resistivity of the ionically resistive element 80*c* becomes higher toward the Z-direction in FIG. 6. The resistivity of the ionically resistive element 80*d* becomes higher toward the Z-direction in FIG. 6.

More specifically, as illustrated in FIG. 8, the ionically resistive elements 80*a* to 80*d* according to this embodiment each have a plurality of openings 81. Then, the ionically resistive elements 80*a* to 80*d* are configured to decrease in opening rates (that is, a proportion of the area of the portion of the openings 81 occupied per unit area of an ionically resistive element) as approaching the power feeding part 62 in the extending directions of the ionically resistive elements 80*a* to 80*d*. Therefore, according to this embodiment, with a simple configuration, the resistivity of the ionically resistive elements 80*a* to 80*d* can be increased as approaching the power feeding part 62.

Note that the respective openings 81 of the ionically resistive elements 80*a* to 80*d* preferably have a size such that gas bubbles (specifically, gas bubbles made of oxygen) generated from the auxiliary anodes 60*a* to 60*d* during the plating process can pass through the openings 81. With this configuration, accumulation of the gas bubbles generated from the auxiliary anodes 60*a* to 60*d* on surfaces opposed to the auxiliary anodes 60*a* to 60*d* of the ionically resistive elements 80*a* to 80*d* can be effectively suppressed. This configuration can exert a high effect especially when the ionically resistive elements 80*a* to 80*d* are arranged so as to extend in the horizontal direction.

The overall resistivity of the respective ionically resistive elements 80*a* to 80*d* may be the same as one another. Specifically, the overall resistivity of the ionically resistive element 80*a* (total resistivity from one end to the other end of the ionically resistive element 80*a*), the overall resistivity of the ionically resistive element 80*b*, the overall resistivity of the ionically resistive element 80*c*, and the overall resistivity of the ionically resistive element 80*d* may be the same in value as one another.

Alternatively, the overall resistivity of the respective ionically resistive elements 80*a* to 80*d* may be different from one another. In this case, the ionically resistive element arranged closer to the power feeding part 62 is preferably configured to have higher overall resistivity than the ionically resistive element arranged farther from the power feeding part 62.

Specifically, the ionically resistive element 80*a* preferably has higher overall resistivity than the ionically resistive element 80*d*. In other words, the resistance value at an end portion ("distal end (end portion on the −Y-direction side in FIG. 6)") of the ionically resistive element 80*a* on a side farther from the power feeding part 62 is preferably higher than the resistance value at an end portion ("proximal end (end portion on the Z-direction side in FIG. 6)") of the ionically resistive element 80*d* on a side closer to the power feeding part 62. In addition, the ionically resistive element 80*c* preferably has higher overall resistivity than the ionically resistive element 80*b*. In other words, the resistance value at the distal end (end portion on the −Z-direction side in FIG. 6) of the ionically resistive element 80*c* is preferably higher than the resistance value at the proximal end (end portion on the Y-direction side in FIG. 6) of the ionically resistive element 80*b*.

With this embodiment described above, the ionically resistive elements 80*a* to 80*d* are configured to increase in resistivity as approaching the power feeding part 62. Therefore, the film thickness on the outer peripheral edge of the substrate Wf becoming non-uniform caused by the connecting parts 63 of the busbar 61 having smaller resistance values as approaching the power feeding part 62 can be suppressed. That is, with this embodiment, the film thickness on the outer peripheral edge of the substrate Wf can be made uniform. As a result, the film thickness in a plane of the substrate Wf can be made uniform.

Modification of Embodiment 1

Figure 9A:
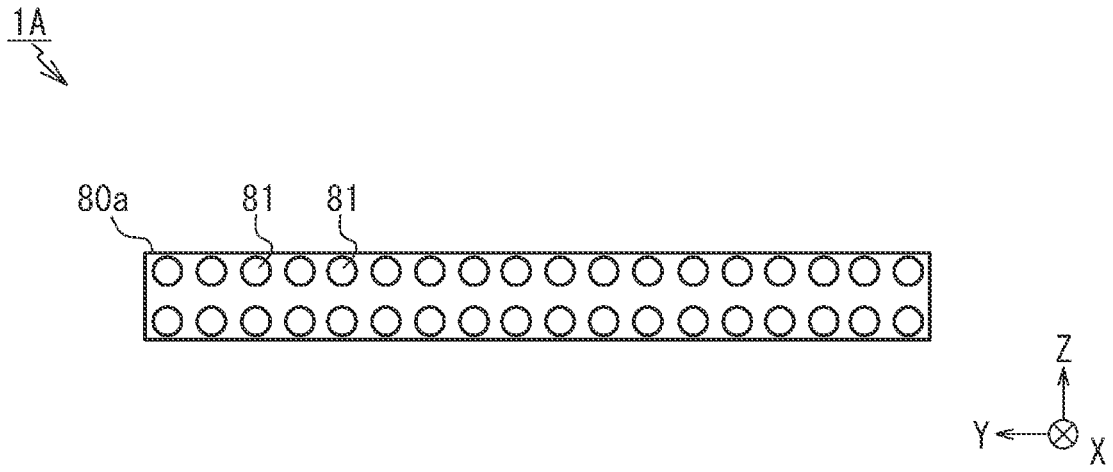
FIG. 9A is a schematic diagram for describing the ionically resistive element of a plating apparatus according to a modification of Embodiment 1.
Figure 9B:
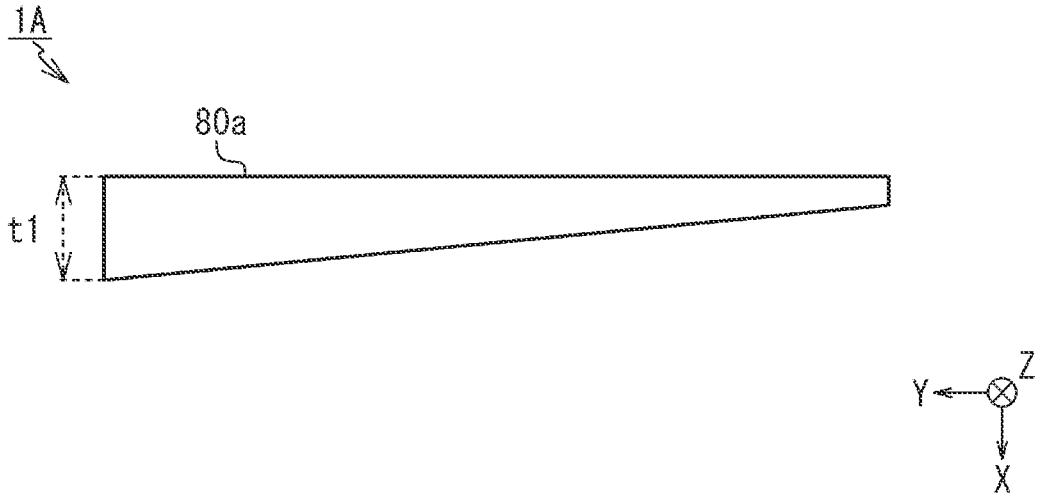
FIG. 9B is a schematic diagram for describing the ionically resistive element of the plating apparatus according to a modification of Embodiment 1.

The configuration of the ionically resistive elements 80*a* to 80*d* is not limited to the configuration described with FIG. 8. As another example of the ionically resistive elements 80*a* to 80*d*, the following one can be used. FIG. 9A and FIG. 9B are schematic diagrams for describing the ionically resistive elements 80*a* to 80*d* of a plating apparatus 1A according to a modification of Embodiment 1. Specifically, FIG. 9A is a schematic front view of one ionically resistive element (the ionically resistive element 80*a*) according to this modification, and FIG. 9B is a schematic side view of one ionically resistive element (the ionically resistive element 80*a*) according to this modification.

The ionically resistive elements 80*a* to 80*d* according to this modification are configured such that the thickness t1 of the ionically resistive elements 80*a* to 80*d* becomes thicker as approaching the power feeding part 62 in the extending directions of the ionically resistive elements 80*a* to 80*d* (see FIG. 9B).

Specifically, with reference to FIG. 9B and above-described FIG. 6, the thickness t1 of the ionically resistive element 80*a* according to this modification becomes thicker toward the Y-direction in the extending direction of the ionically resistive element 80*a*. The thickness t1 of the ionically resistive element 80*b* according to this modification also becomes thicker toward the Y-direction in the extending direction of the ionically resistive element 80*b*. The thickness t1 of the ionically resistive element 80*d* according to this modification becomes thicker toward the Z-direction in the extending direction of the ionically resistive element 80*d*. The thickness t1 of the ionically resistive element 80*c* according to this modification also becomes thicker toward the Z-direction in the extending direction of the ionically resistive element 80*c*.

Moreover, as illustrated in FIG. 9A, the ionically resistive elements 80*a* to 80*d* according to this modification may have the plurality of openings 81. In this case, as illustrated in FIG. 9A, the opening rates of the ionically resistive elements 80*a* to 80*d* according to this modification may be uniform regardless of electrical distances from the power feeding part 62.

With this modification, with a simple configuration in which the thickness t1 of the ionically resistive elements 80*a* to 80*d* becomes thicker as approaching the power feeding part 62 in the extending directions of the ionically resistive elements 80*a* to 80*d*, the resistivity of the ionically resistive elements 80*a* to 80*d* can be increased as approaching the power feeding part 62.

Embodiment 2

Figure 10:
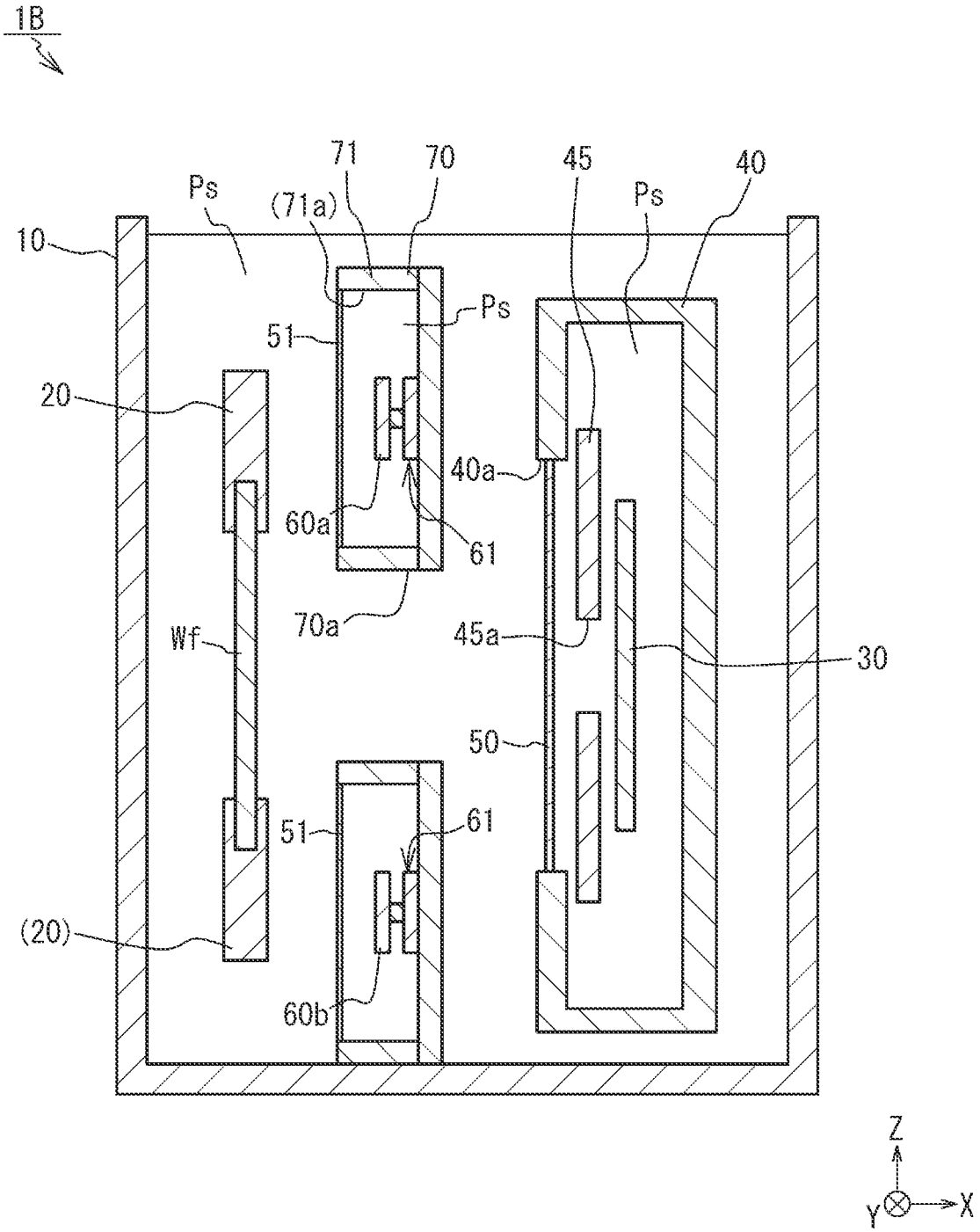
FIG. 10 is a schematic cross-sectional view illustrating a peripheral configuration of one plating tank in a plating apparatus according to Embodiment 2.

Subsequently, a plating apparatus 1B according to Embodiment 2 will be described. FIG. 10 is a schematic cross-sectional view illustrating a peripheral configuration of one plating tank 10 in the plating apparatus 1B according to this embodiment. The plating apparatus 1B according to this embodiment is different from the plating apparatus 1 illustrated in FIG. 2 in that the ionically resistive elements 80*a* to 80*d* are not included.

Figure 11:
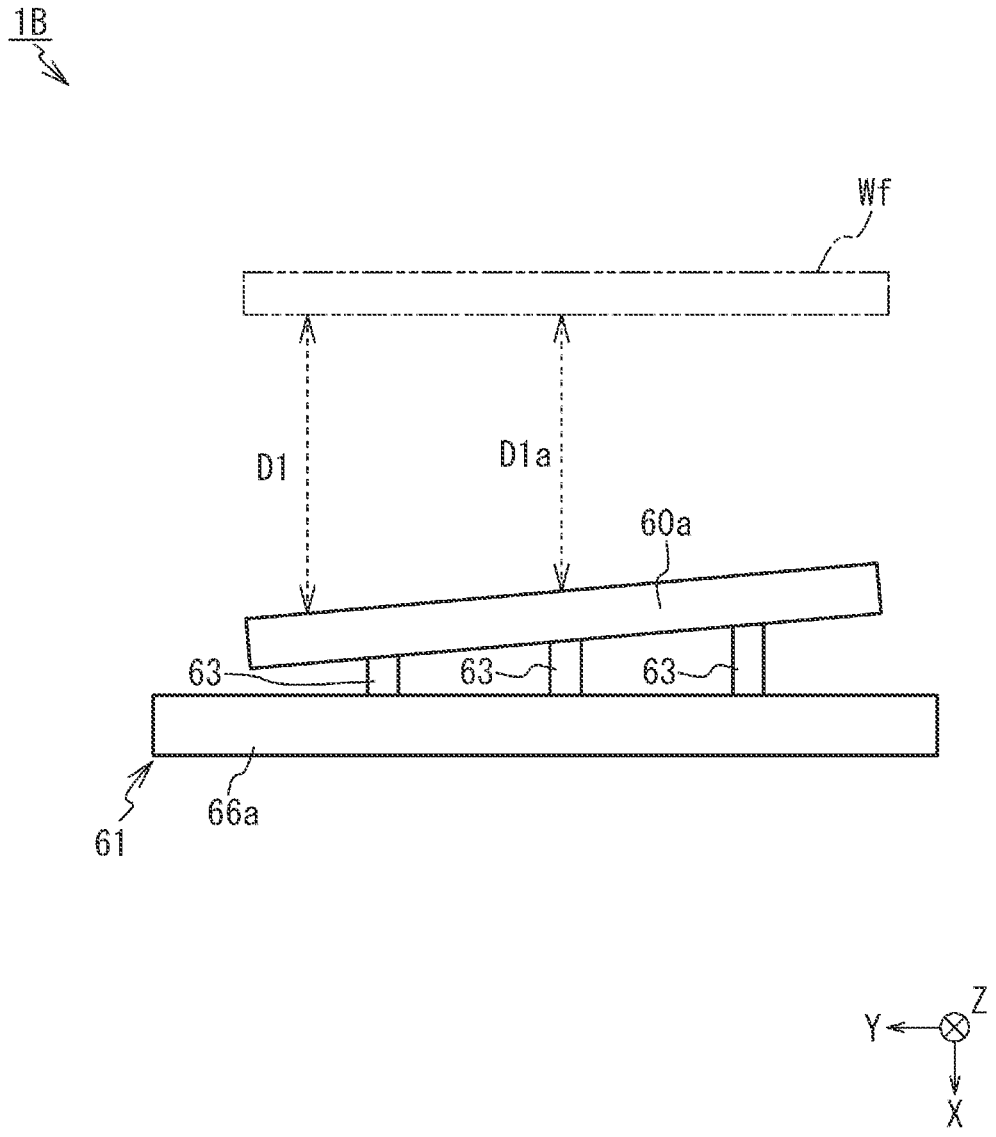
FIG. 11 is a schematic side view of a peripheral configuration of an auxiliary anode according to Embodiment 2.
Figure 12:
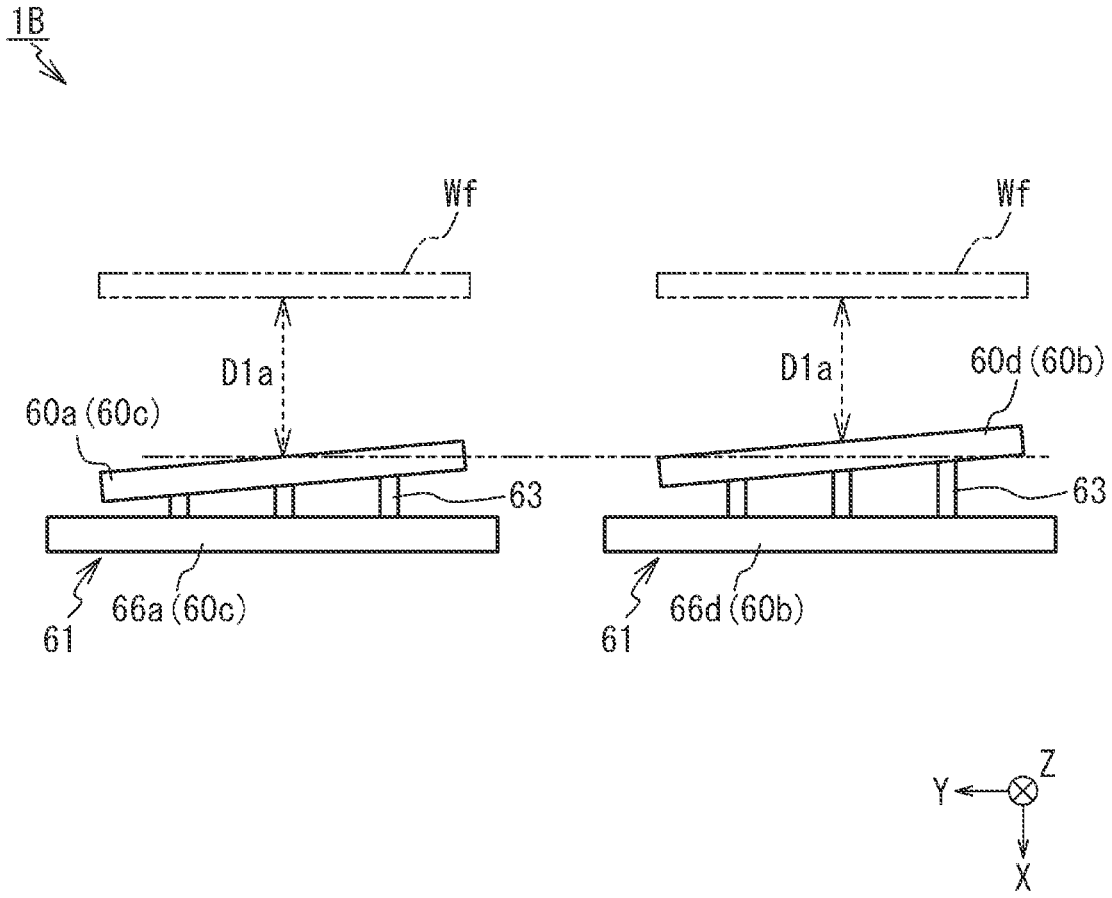
FIG. 12 is a schematic diagram for comparing a pair of auxiliary anodes adjacent to one another according to Embodiment 2.

FIG. 11 is a schematic side view of a peripheral configuration of one auxiliary anode (the auxiliary anode 60*a*) according to this embodiment. FIG. 12 is a schematic diagram for comparing a pair of auxiliary anodes adjacent to one another. With reference to FIG. 11, FIG. 12, and above-described FIG. 5, the auxiliary anodes 60*a* to 60*d* according to this embodiment are different from the auxiliary anodes (see FIG. 7) according to the above-described embodiment in that they are configured such that a distance D1 between the auxiliary anodes 60*a* to 60*d* and the substrate Wf increases as approaching the power feeding part 62 in the extending directions of the auxiliary anodes 60*a* to 60*d*. The other configuration of the auxiliary anodes 60*a* to 60*d* according to this embodiment is similar to that of the auxiliary anodes according to the above-described embodiment.

Specifically, the auxiliary anode 60*a* according to this embodiment is configured such that the distance D1 between the auxiliary anode 60*a* and the substrate Wf (specifically, the side 90*a*) increases toward the Y-direction. The auxiliary anode 60*b* according to this embodiment is also configured such that the distance D1 between the auxiliary anode 60*b* and the substrate Wf (specifically, the side 90*b*) increases toward the Y-direction. The auxiliary anode 60*c* according to this embodiment is configured such that the distance D1 between the auxiliary anode 60*c* and the substrate Wf (specifically, the side 90*c*) increases toward the Z-direction. The auxiliary anode 60*d* according to this embodiment is also configured such that the distance D1 between the auxiliary anode 60*d* and the substrate Wf (specifically, the side 90*d*) increases toward the Z-direction.

Moreover, as illustrated in FIG. 12, when a pair of auxiliary anodes adjacent to one another when viewed from the direction in which electricity flows are compared, the auxiliary anode arranged at a position closer to the power feeding part 62 preferably has a large distance average value D1*a* between the auxiliary anode and the substrate Wf compared with the auxiliary anode arranged at a position farther from the power feeding part 62.

Specifically, as illustrated in FIG. 12, when the auxiliary anode 60*a* and the auxiliary anode 60*d* adjacent to one another are compared, the distance average value D1*a* between the auxiliary anode 60*a* and the substrate Wf is preferably larger than the distance average value D1*a* between the auxiliary anode 60*d* and the substrate Wf. Similarly, when the auxiliary anode 60*c* and the auxiliary anode 60*b* adjacent to one another are compared, the distance average value D1*a* between the auxiliary anode 60*c* and the substrate Wf is preferably larger than the distance average value D1*a* between the auxiliary anode 60*b* and the substrate Wf.

In this case, the distance average value D1*a* between the auxiliary anode 60*a* and the substrate Wf may be the same as the distance average value D1*a* between the auxiliary anode 60*c* and the substrate Wf. Similarly, the distance average value D1*a* between the auxiliary anode 60*d* and the substrate Wf may be the same as the distance average value D1*a* between the auxiliary anode 60*b* and the substrate Wf.

With this embodiment, the distance D1 between the auxiliary anodes 60*a* to 60*d* and the substrate Wf is configured to increase as approaching the power feeding part 62 in the extending directions of the auxiliary anodes 60*a* to 60*d*. Therefore, the film thickness on the outer peripheral edge of the substrate Wf becoming non-uniform caused by the connecting parts 63 of the busbar 61 having smaller resistance values as approaching the power feeding part 62 can be suppressed.

Working Example

A working effect of the embodiments described above was confirmed by an experiment. A description will be given of this. First, as a plating apparatus according to a working example, the plating apparatus 1 according to the above-described Embodiment 1 was prepared. In addition, as a plating apparatus according to a comparative example, a plating apparatus having the same configuration as the plating apparatus 1 according to the working example, except that no ionically resistive element was included, was prepared.

Then, using each of the plating apparatus 1 according to the working example and the plating apparatus according to the comparative example, a plating process was performed on the substrate Wf under the same plating process condition, and the film thickness of the substrate Wf after the plating process was measured. Specifically, with reference to FIG. 3, the film thickness on the outer peripheral edge of the plating film of the substrate Wf after the plating process was measured. More specifically, by setting the film thickness at the periphery of the corner portion 91*a* closest to the power feeding part 62 as a "starting point," the film thickness was measured in a direction (clockwise direction) indicated by arrows in FIG. 3. The measurement results of the film thickness are shown in FIG. 13.

Figure 13:
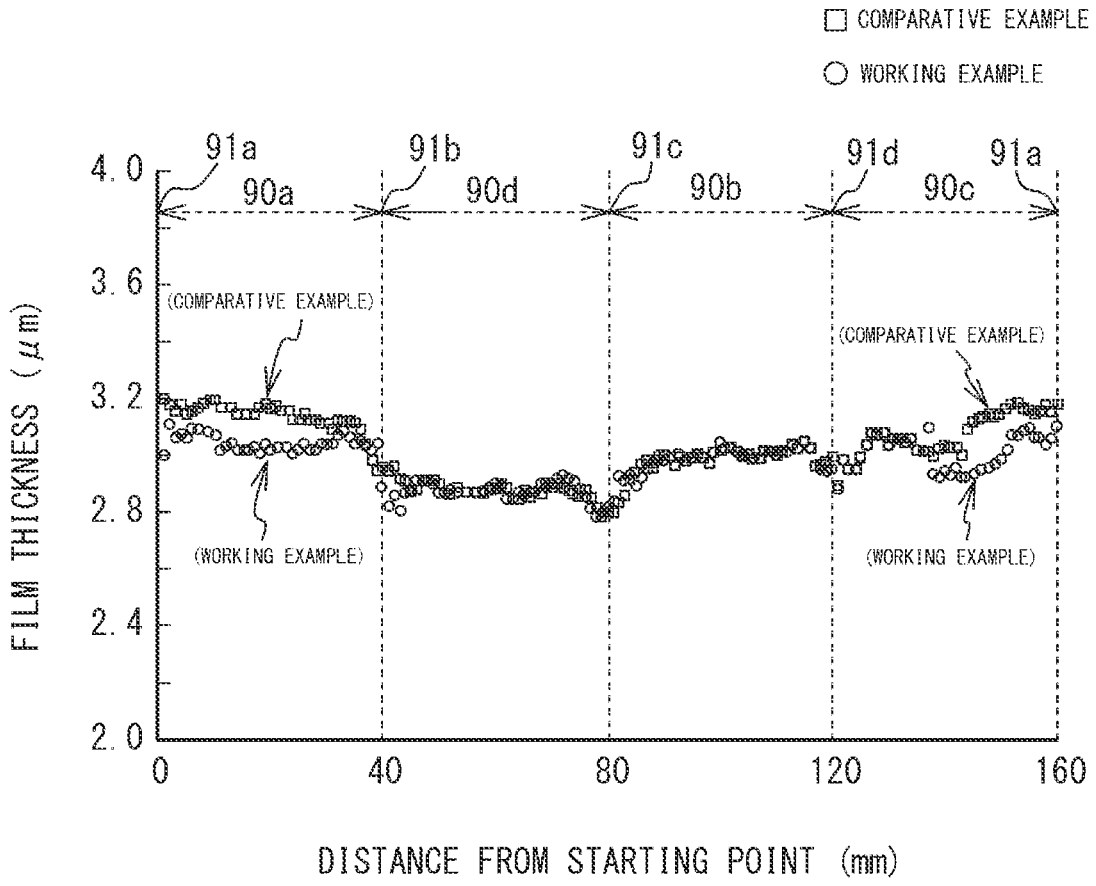
FIG. 13 is a chart indicating measurement results of film thickness.

The horizontal axis in FIG. 13 indicates a distance (mm) from the "starting point." The vertical axis in FIG. 13 indicates the film thickness of the substrate Wf (that is, the film thickness (μm) of the plating film formed on the substrate Wf). As understood from FIG. 13, when the plating process was performed on the substrate Wf using the plating apparatus according to the comparative example, on the outer peripheral edge of the substrate Wf, the film thickness at the periphery of the corner portion 91*a* closer to the power feeding part 62 is the highest, and the film thickness at the periphery of the corner portion 91*c* farther from the power feeding part 62 is the lowest. Then, in the comparative example, film-thickness distribution on the outer peripheral edge of the plating film of the substrate Wf is 6.8% measured according to "Range/2Ave (that is, (maximum value−minimum value of film thickness)/(average value of film thickness×2))."

In contrast to this, when the plating process was performed on the substrate Wf using the plating apparatus 1 according to the working example, on the whole, the film thickness at the periphery of the corner portion 91*a* closer to the power feeding part 62 in the substrate Wf is the highest, and the film thickness at the periphery of the corner portion 91*c* farther from the power feeding part 62 is the lowest. However, the film thickness at the periphery of the corner portion 91*a* is a small thickness compared with the comparative example. As a result, in the working example, compared with the comparative example, the film thickness on the outer peripheral edge of the substrate Wf is made uniform in whole. As a specific example of a numerical value, in the working example, the film-thickness distribution on the outer peripheral edge of the substrate Wf is 5.5% (Range/2Ave), and the numerical value is small compared with the comparative example. That is, compared with the comparative example, the working example ensures making the film-thickness distribution on the outer peripheral edge of the substrate Wf uniform.

Note that for the above-described plating apparatus 1A according to the modification of the Embodiment 1 and the plating apparatus 1B according to the Embodiment 2, the plating process was performed on the substrate Wf under the condition similar to that for Embodiment 1 to measure the film thickness. As a result, in the plating apparatus 1A and the plating apparatus 1B, similarly to the plating apparatus 1 according to the working example, the value of 5.5% (Range/2Ave) was also obtained as the film-thickness distribution on the outer peripheral edge of the substrate Wf. As described above, the effect of the above-described embodiments was confirmed by the experiment.

Although the embodiments of the present invention have been described in detail above, the present invention is not limited to such specific embodiments, and further various kinds of variants and modifications are possible within the scope of the gist of the present invention described in the claims.

REFERENCE SIGNS LIST

1 . . . plating apparatus
10 . . . plating tank
20 . . . substrate holder
30 . . . anode
51 . . . membrane
60*a*, 60*b*, 60*c*, 60*d* . . . auxiliary anode
61 . . . busbar
62 . . . power feeding part
63 . . . connecting part
64 . . . joining part
71 . . . housing portion
80*a*, 80*b*, 80*c*, 80*d* . . . ionically resistive element
Ps . . . plating solution
Wf . . . substrate
D1 . . . distance
t1 . . . thickness

The invention claimed is:

1. A plating apparatus comprising:

a plating tank configured to accumulate a plating solution;

an anode arranged inside the plating tank;

a substrate holder configured to allow arranging a substrate such that the substrate is opposed to the anode inside the plating tank;

at least one auxiliary anode arranged between the anode and the substrate inside the plating tank and extending so as to be along an outer peripheral edge of the substrate;

a busbar having a power feeding part to which electricity is supplied and a plurality of connecting parts, the plurality of connecting parts connected to the at least one auxiliary anode and arrayed in an extending direction of the at least one auxiliary anode, the busbar being configured to flow the electricity supplied to the power feeding part to the at least one auxiliary anode via the connecting parts; and at least one ionically resistive element arranged between the at least one auxiliary anode and the substrate inside the plating tank and extending so as to be along the at least one auxiliary anode, wherein the at least one ionically resistive element is configured to increase in resistivity of the ionically resistive element as approaching the power feeding part in an extending direction of the at least one ionically resistive element.

2. The plating apparatus according to claim 1, wherein the at least one ionically resistive element has a plurality of openings, and the at least one ionically resistive element decreasing in opening rate as approaching the power feeding part in the extending direction of the at least one ionically resistive element causes the at least one ionically resistive element to increase in resistivity as approaching the power feeding part in the extending direction of the at least one ionically resistive element.

3. The plating apparatus according to claim 1, wherein the at least one ionically resistive element increasing in thickness as approaching the power feeding part in the extending direction of the at least one ionically resistive element causes the at least one ionically resistive element to increase in resistivity as approaching the power feeding part in the extending direction of the at least one ionically resistive element.

4. The plating apparatus according to claim 1, wherein the busbar has a joining part configured to join the power feeding part and the connecting parts, the joining part has a plurality of extending parts extending so as to be along an outer peripheral edge of the substrate, the plurality of extending parts are arranged in a frame shape, the at least one auxiliary anode includes a plurality of the auxiliary anodes, and the respective auxiliary anodes are connected to the respective extending parts via the plurality of connecting parts.

5. The plating apparatus according to claim 1, wherein the plating apparatus includes a housing portion configured to house the at least one auxiliary anode inside the housing portion, the housing portion is provided with an opening facing the substrate, and the opening of the housing portion is closed by a membrane configured to allow metal ions contained in the plating solution to pass through the membrane and restrict oxygen generated from surfaces of the at least one auxiliary anode from passing through the membrane.

6. A plating apparatus comprising:

a plating tank configured to accumulate a plating solution;

an anode arranged inside the plating tank;

a substrate holder configured to allow arranging a substrate such that the substrate is opposed to the anode inside the plating tank;

at least one auxiliary anode arranged between the anode and the substrate inside the plating tank and extending so as to be along an outer peripheral edge of the substrate; and a busbar having a power feeding part to which electricity is supplied and a plurality of connecting parts, the plurality of connecting parts connected to the at least one auxiliary anode and arrayed in an extending direction of the at least one auxiliary anode, the busbar being configured to flow the electricity supplied to the power feeding part to the at least one auxiliary anode via the connecting parts, wherein the at least one auxiliary anode is configured such that a distance between the at least one auxiliary anode and the substrate increases as approaching the power feeding part in an extending direction of the at least one auxiliary anode.

* * * * *